US012121171B2

(12) United States Patent
Kim

(10) Patent No.: US 12,121,171 B2
(45) Date of Patent: Oct. 22, 2024

(54) VENTILATING HANGER

(71) Applicant: Hak-Soo Kim, Incheon (KR)

(72) Inventor: Hak-Soo Kim, Incheon (KR)

( * ) Notice: Subject to any disclaimer, the term of this patent is extended or adjusted under 35 U.S.C. 154(b) by 0 days.

(21) Appl. No.: 18/251,738

(22) PCT Filed: Nov. 4, 2021

(86) PCT No.: PCT/KR2021/015848
§ 371 (c)(1),
(2) Date: May 4, 2023

(87) PCT Pub. No.: WO2022/103066
PCT Pub. Date: May 19, 2022

(65) Prior Publication Data

US 2023/0404307 A1 Dec. 21, 2023

(30) Foreign Application Priority Data

Nov. 10, 2020 (KR) ..... 10-2020-0149525

(51) Int. Cl.
*A47G 25/40* (2006.01)
*A47G 25/28* (2006.01)
*A47G 25/48* (2006.01)

(52) U.S. Cl.
CPC ..... *A47G 25/40* (2013.01); *A47G 25/28* (2013.01); *A47G 25/485* (2013.01)

(58) Field of Classification Search
CPC .... A47G 25/1485; A47G 25/20; A47G 25/28; A47G 25/40; A47G 25/481; A47G 25/484
See application file for complete search history.

(56) References Cited

U.S. PATENT DOCUMENTS 883,785 A * 4/1908 Cazier ..... A47G 25/481 223/96
2,467,623 A * 4/1949 Lamothe ..... A47G 25/481 223/91
3,744,686 A * 7/1973 Levitin ..... A47G 25/183 24/535
D471,367 S * 3/2003 Laguelle ..... D6/326
2015/0157156 A1* 6/2015 Barre ..... A47G 25/34 223/85
2015/0182055 A1* 7/2015 Gouldson ..... A47G 25/4038 223/85
2018/0184830 A1* 7/2018 Yau ..... A47G 25/48
(Continued)

FOREIGN PATENT DOCUMENTS

CN 205493436 U 8/2016
CN 107510340 A * 12/2017
(Continued)

*Primary Examiner* — Shaun R Hurley
(74) *Attorney, Agent, or Firm* — You & IP, LLC

(57) ABSTRACT

Proposed is a hanger capable of being opened forward/rearward and, more particularly, to a ventilating hanger having a hanging part on which clothes can be hung and which can be opened toward front/back of clothes, so that the hanging part is in a narrow state to allow the clothes to ba easily hung thereon when the clothes are hung, and is opened to be wide forward/rearward in a state in which the clothes are hung thereon, so as to widen the space between the front and back of the clothes, and thus smooth ventilation is facilitated.

8 Claims, 7 Drawing Sheets

(56) References Cited

U.S. PATENT DOCUMENTS

| | | | | |
|---|---|---|---|---|
| 2018/0303263 | A1* | 10/2018 | Jones | A47G 25/32 |
| 2020/0085221 | A1* | 3/2020 | Riedel | A47G 25/483 |

FOREIGN PATENT DOCUMENTS

| | | | | |
|---|---|---|---|---|
| JP | 3179397 | U | | 11/2012 |
| JP | 3199204 | U | | 8/2015 |
| JP | 2018-015096 | A | | 2/2018 |
| KR | 20-0170069 | Y1 | | 2/2000 |
| KR | 10-2011-0063392 | A | | 6/2011 |
| KR | 20110112537 | A | * | 10/2011 |

* cited by examiner

VENTILATING HANGER

TECHNICAL FIELD

The present disclosure relates to a hanger capable of being opened forward/rearward and, more particularly, to a ventilating hanger having a hanging part on which clothes can be hung and which can be opened toward the front/back of clothes, so that the hanging part is in a narrow state to allow the clothes to be easily hung thereon when the clothes are hung, and is opened to be wide forward/rearward in a state in which the clothes are hung thereon, so as to widen the space between the front and back of the clothes, and thus smooth ventilation is facilitated.

BACKGROUND ART

Unless otherwise indicated herein, material described in this section is not related art to the claims in this application, and inclusion in this section is not an admission that it is related art.

Thin wire hangers have the disadvantage of easily stretching out the shoulder area of clothes and distorting the shape when clothes, such as T-shirts, made from thin or stretchy fabric are hung thereon. Another downside of wire hangers is that, due to a narrow width, ventilation is difficult and wet clothes take a very long time to dry. While narrow profile of a wire hanger makes it easy to hang clothes, it makes the front and back parts of the clothes stick together. To compensate for the disadvantages of wire hangers, there is a so-called suit hanger with a wider width and anti-slip treatment. Suit hangers have wide profile, so the front and back parts of clothes may be considerably spaced apart, allowing for smooth ventilation inside the clothes. Yet, because of the wider width, clothes can be hung only after opening fasteners, such as buttons, of clothes including shirts or suits that are open on one side, which means the suit hanger is not suitable for hanging clothes made of thin or stretchy material such as T-shirts.

An example of related art devised to solve the above-described problems is Korean Patent Application Publication No. 10-2011-0063392 "ONE TOUCH FOLDABLE HANGER". This hanger features one-touch folding and unfolding, and includes: a board having a fitting protrusion at each end of the central part, a guide rail inside the upper part of the center, and a stopper protruding from each side of the upper part; a lift mechanism having a guide protrusion at the rear of a shaft at the bottom of a hook, a push bar at the bottom of the shaft, a locking jaw at each end of the shaft, and a lock/release function portion at the top of one side of the push bar; and a shoulder portion having a fitting hole into which a fitting protrusion of the board is inserted.

In the case of traditional garment hangers with unfoldable aims as described above, the neck part of clothes has to be forcibly stretched to insert a hanger when hanging T-shirts, knitwear, and round-neck integrated jackets with a narrow neck, and thus the shape of the neck part is deformed or it is difficult to insert the hanger. Moreover, since the arms of the hanger are always in an unfolded state, whether in use or not, it is difficult to store, inconvenient to use, and distracting in appearance. The above example of related art is intended to address these problems of the traditional hangers. Still, while the one touch foldable hanger allows of hanging clothes such as T-shirts, knitwear, and round-neck integrated jackets with a narrow neck, it does not provide structure to facilitate ventilation.

DISCLOSURE

Technical Problem

The present disclosure has been made keeping in mind the problems occurring in the related art. An objective of the present disclosure is to provide a ventilating hanger that can be widened due to the hinge configuration by narrowing the gap between the upper parts thereof so that the lower parts thereof spread forward and rearward, can easily hang clothes such as T-shirts, knitwear, and round-neck integrated jackets with a narrow neck when the hanger is in a narrow-width state, and can enable smooth ventilation by spreading the lower parts forward and rearward while clothes are hung. An objective of the present disclosure is to provide a ventilating hanger that has fastening parts formed on the upper parts thereof to fasten the upper parts and spread the lower parts forward and rearward while maintaining the spacing between the front and rear of the hanger, and the fastened state can be loosened by means of a simple push button.

Objectives of the present disclosure is not limited to the one described above, and it is obvious that other objectives may be derived from the following description.

Technical Solution

A ventilating hanger according to an embodiment of the present disclosure, inserted into clothes and forming a predetermined space therein where the clothes are hung, includes: a body part configured to have a semicircular hook part foamed at the top; a body rotation shaft formed by protruding a side of the body part and in which a fitting groove is formed; an auxiliary part configured to have an auxiliary rotation shaft coupled to the body rotating shaft, and formed corresponding to a side of the body part; and a stopper rotatably coupled to the body part and the auxiliary part and configured to have a fitting protrusion formed thereon.

According to a preferred feature of the present disclosure, hanging parts configured to extend both ends of the body part and the auxiliary part may be further included.

According to a preferred feature of the present disclosure, an auxiliary hanging part formed by an upper one side of one of the hanging parts is drawn into a center of the body part may be further included.

According to a preferred feature of the present disclosure, one or more hanger clip parts coupled to a lower side of the body part may be further included.

According to a preferred feature of the present disclosure, a body hook cover configured to wrap around a side of the hook part in a direction of the body part may be further included.

According to a preferred feature of the present disclosure, an auxiliary hook cover configured to wrap around a side of the hook part in a direction of the auxiliary part may be further included.

A ventilating hanger according to another embodiment of the present disclosure includes:

a body part configured to have a semicircular hook part formed at the top; a body penetration part formed by penetrating a side of the body part; an auxiliary part foamed corresponding to a side of the body part; a hanging rotation shaft formed on a side of the auxiliary part corresponding to a lower part of the body penetration part; and an expansion stopper in which one end thereof is rotatably coupled to the hanging rotation shaft, and from which an expansion protrusion is formed to protrude at the other end thereof.

According to a preferred feature of the present disclosure, one or more hanger clip parts coupled to lower sides of the body part and the auxiliary part may be further included.

According to a preferred feature of the present disclosure, on the lower sides of the body part and the auxiliary part, a plurality of support protrusions may be formed at regular intervals in a width direction, and in each of the hanger clip parts, a support groove in which one of the support protrusions is inserted may be foamed.

Advantageous Effects

According to an embodiment of the present disclosure, since the width of a ventilating hanger can be widened due to the hinge configuration by narrowing the gap between the upper parts thereof to spread the lower parts thereof forward and rearward, it is possible to easily hang clothes such as T-shirts, knitwear, and round-neck integrated jackets with a narrow neck when the hanger is in a narrow-width state, and to enable smooth ventilation by spreading the lower parts forward and rearward while clothes are hung.

Furthermore, since the ventilating hanger has fastening parts formed on the upper parts thereof, it is possible to fasten the upper parts and spread the lower parts forward and rearward while maintaining the spacing between the front and rear of the hanger, and loosen the fastened state by means of a simple push button.

Effects obtainable in the present disclosure are not limited to the effects mentioned above, and it should be understood that all other effects that can be inferred from the detailed description of the present disclosure or the configuration of the invention described in the claims are included.

BEST MODE

Figure 1:
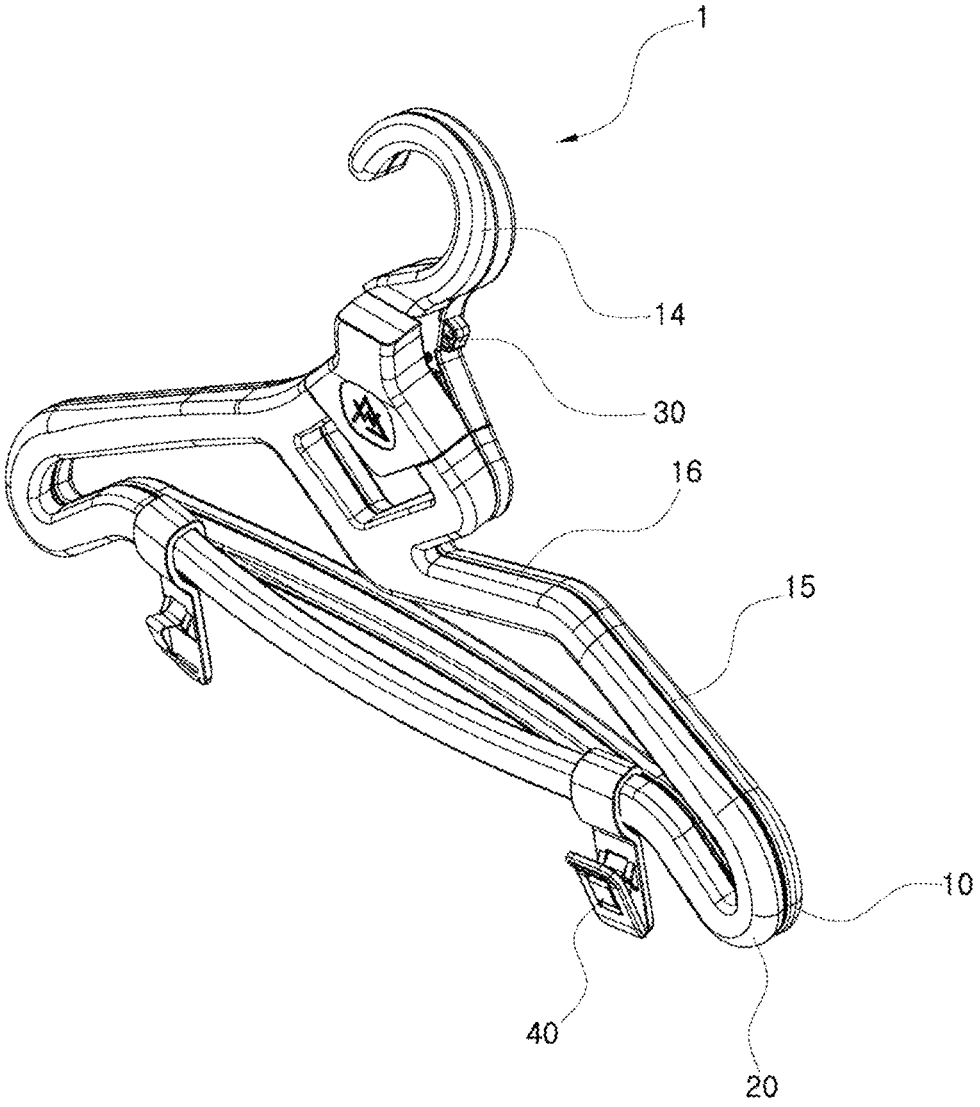
FIG. 1 is a perspective view of a ventilating hanger according to an embodiment of the present disclosure.

Hereinafter, with reference to the accompanying drawings, the configuration, operation and effects of a ventilating hanger according to preferred embodiments will be described. For reference, in the drawings, each component is omitted or schematically illustrated for convenience and clarity, and the size of each component does not reflect the actual size. In addition, like reference numerals refer to like components throughout the specification, and reference numerals for like components in individual drawings will be omitted.

Figure 2:
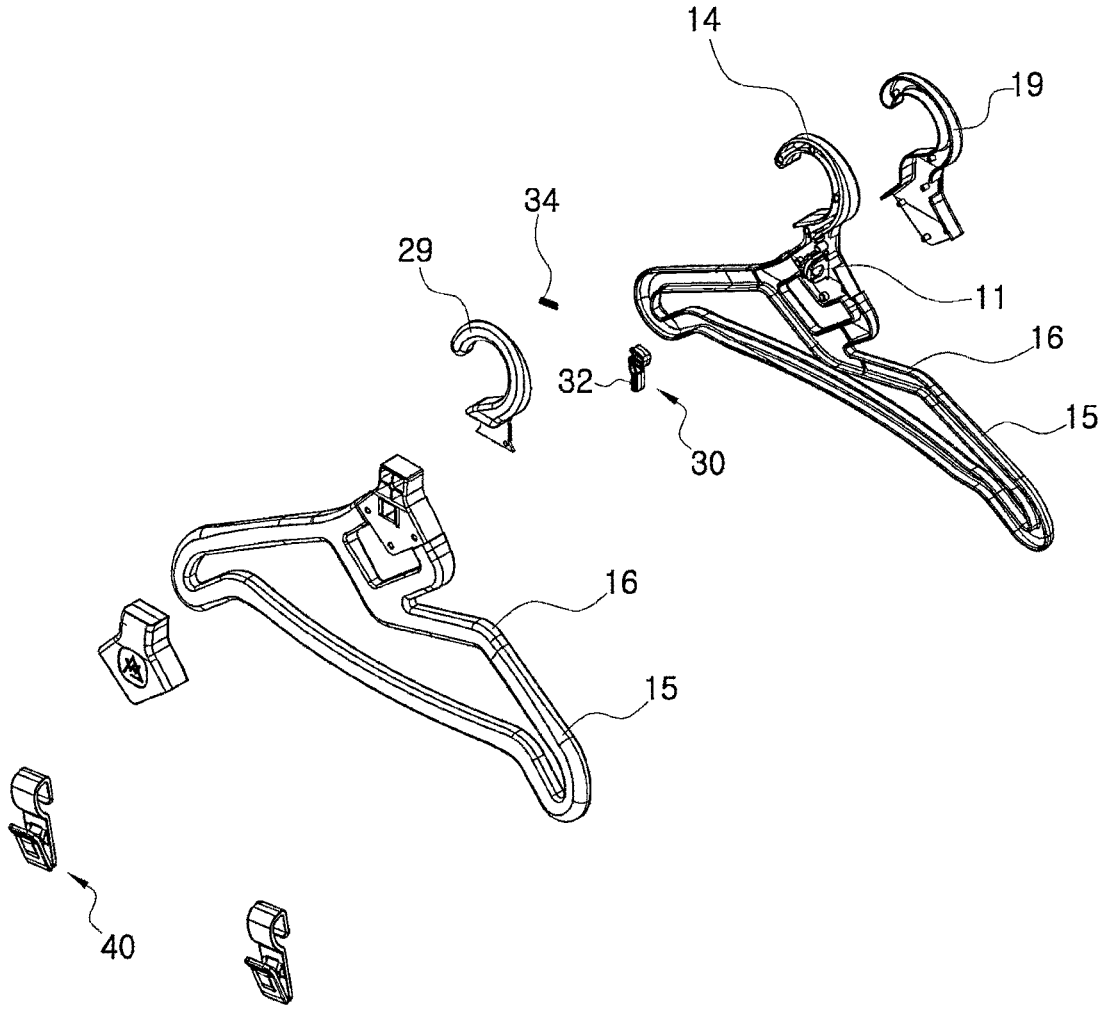
FIG. 2 is an exploded perspective view of the ventilating hanger according to the embodiment of the present disclosure.
Figure 3:
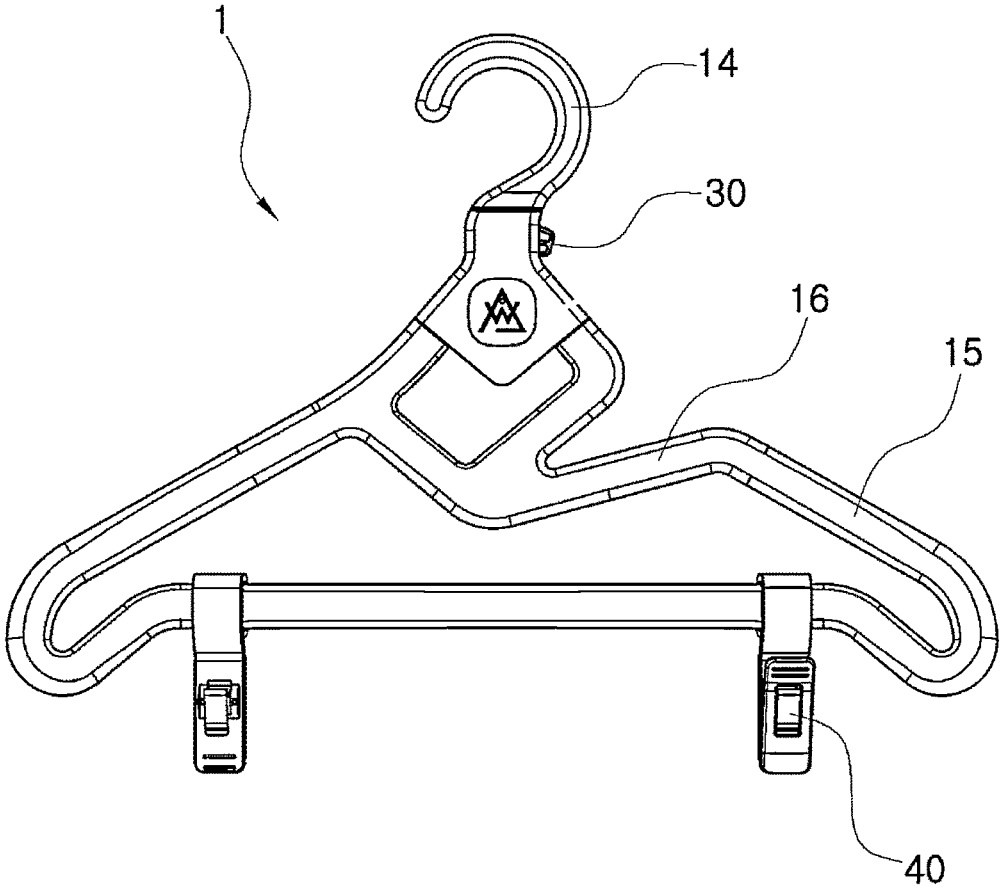
FIG. 3 is a front view of the ventilating hanger according to the embodiment of the present disclosure.
Figure 4A:
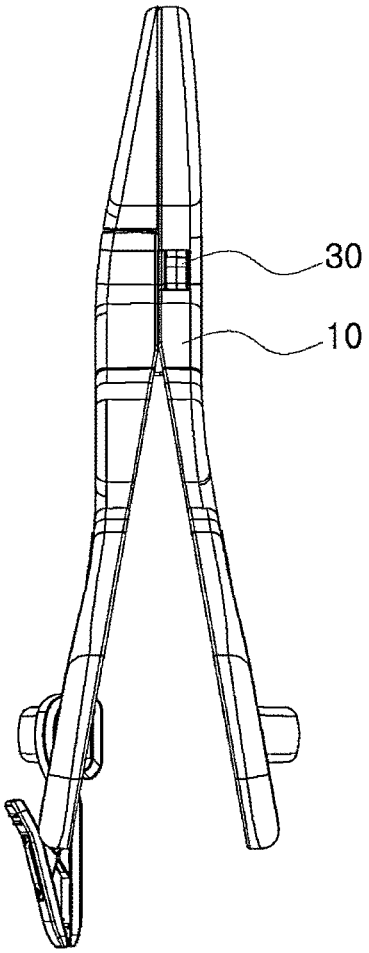
FIG. 4A is a side view after expansion of the ventilating hanger and FIG. 4B is a side view before expansion of the ventilating hanger, according to the embodiment of the present disclosure.
Figure 4B:
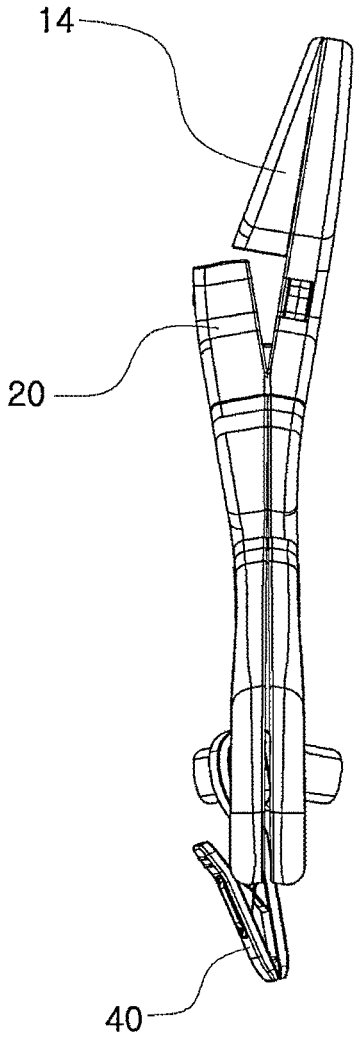
Figure 5A:
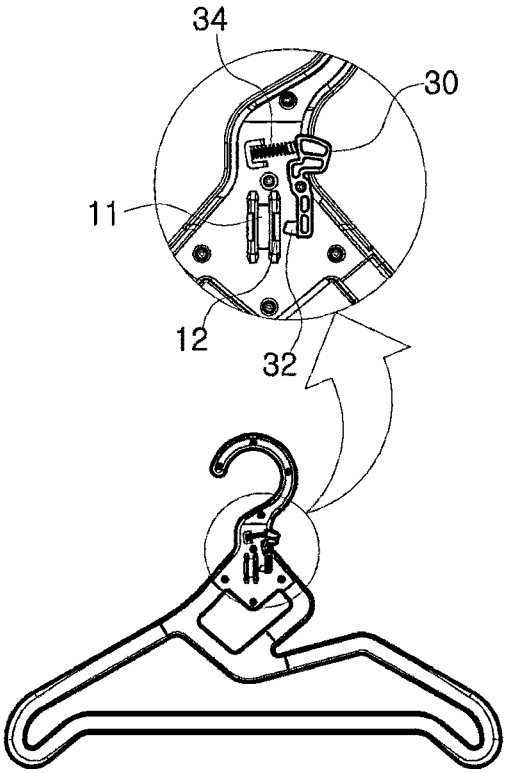
FIG. 5A is a front view of the ventilating hanger and FIG. 5B is a perspective view from the rear side of the ventilating hanger, according to the embodiment of the present disclosure.
Figure 5B:
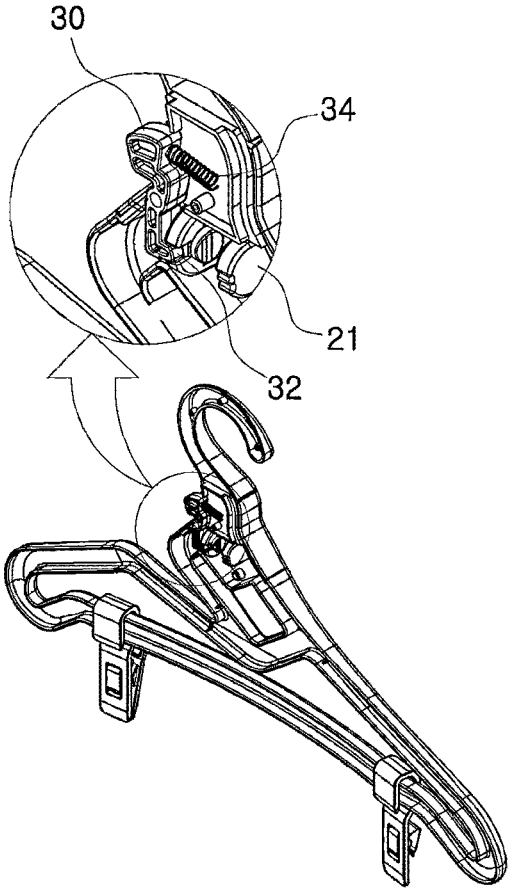

FIG. 1 is a perspective view, FIG. 2 is an exploded perspective view, FIG. 3 is a front view, FIG. 4A is a side view before and after expansion and FIG. 4B is a side view before expansion, and FIG. 5A is a cross-sectional front view of a ventilating hanger and FIG. 5B is a perspective view from the rear side of a ventilating hanger according to an embodiment of the present disclosure.

A ventilating hanger 1 inserted into clothes and forming a predetermined space therein where the clothes are hung, the hanger 1 according to an embodiment of the present disclosure includes:

a body part 10 having a semicircular hook part 14 foamed at the top; a body rotation shaft 11 formed by protruding one side of the body part 10 and in which a fitting groove 12 is formed; an auxiliary part 20 having an auxiliary rotation shaft 21 coupled to the body rotating shaft 11 and formed corresponding to one side of the body part 10; and a stopper 30 rotatably coupled to the body part 10 and the auxiliary part 20 and having a fitting protrusion 32 foamed thereon.

The hook part 14 is bent after protruding upward, so that the hanger may be caught on a part of a hanging rod. It is preferable that the hook part 14 is streamlined, but the hook part 14 may be configured in various shapes as long as the hook part 14 can accommodate the rod. The body part 10 has a triangular frame, and the hook part 14 is formed extending from the top. When the hook part 14 extends from the body part 10, it is possible that the hook part 14 is bent in one direction when viewed from the side. The center of the triangular frame may be opened, allowing for better air circulation and improving aesthetics. By configuring the left and right sides of the frame in an asymmetrical shape, clothes such as ties and pants may be hung on one side.

The body rotation shaft 11 foamed by protruding one side of the body part 10 is preferably formed in an obtuse direction in a bent portion extending from the body part 10 to the hook part 14, and one side thereof may be retracted to form a fitting groove 12. The body rotation shaft 11 may have one side in a semicircular shape in order to serve as a shaft capable of rotating. When viewed from the side, the body part 10 is capable of rotating around the body rotation shaft 11. One side of the central portion of the body rotation shaft 11 is drawn in to form the fitting groove 12, and a member corresponding to the fitting groove 12 and capable of fixing the body rotation shaft 11 so as not to rotate may be in-coupled.

In addition, the auxiliary part 20 corresponding to one side of the body part 10 is formed to correspond to the shape of the body part and may be coupled to the body part 10 without the hook part 14 being formed at the top. The auxiliary part 20 may not be correspondingly coupled to the body part 10 on its entire side. The auxiliary part 20 may be bent based on the auxiliary rotation shaft 21 formed on the side, so that when one side of the auxiliary part 20 is engaged with the body part 10, the other side of the auxiliary part 20 is rotated based on the bent part and separated from the body part 10. Since the auxiliary rotation shaft 21 may be rotatably coupled to the body rotation shaft 11, the body part 10 and the auxiliary part 20 may be rotated in a coupled state.

In addition, the stopper 30 has the fitting protrusion 32 formed on one side thereof to be coupled to the body part 10 and the auxiliary part 20. When the body part 10 and the auxiliary part 20 rotate around the body rotation shaft 11 and are separated from each other to widen the lower part of the hanger as necessary, the fitting groove 12 formed on the body rotation shaft 11 and the fitting protrusion 32 formed on one side of the stopper 30 coincide in one direction, and the stopper 30 is rotated by the force of a spring (34), and the fitting protrusion 32 is drawn into the fitting groove 12, so that the body part 10 and the auxiliary part 20 are fixed so as not to be rotated, thereby opening up the lower part of the ventilating hanger 1 to form a shape that allows smooth ventilation. When a user presses the stopper 30 protruding out through a portion of the body part 10 to loosen the fixed state, a force is applied to the spring (34), and as the fitting protrusion 32 inserted into the fitting groove 12 is dislodged, the fixed state is loosened and rotation of the body part 10 and the auxiliary part 20 becomes possible again.

Hanging parts 15 extending both ends of the body part 10 and the auxiliary part 20 are further provided.

The hanging parts 15 extend to both ends of the body part 10 to prevent clothes from falling out to one side upon hanging, and the auxiliary part 20 may also form the hanging parts 15 extending both ends thereof so that the auxiliary part 20 may be engaged with the body part 10.

An auxiliary hanging part 16 formed by an upper one side of the hanging part 15 is drawn into the center of the body part 10 is further provided.

When the upper sides of the hanging parts 15 are tilted in the lower direction of both ends of the body part 10 and the auxiliary part 20, it is preferable that the auxiliary hanging parts 16 are parallel to the floor or tilted in a direction opposite to the direction in which the hanging parts 15 are tilted. Since the area of the auxiliary hanging part 16 is narrower than the area of the hanging part 15, it is not advisable to hang large size clothing, and towels or narrow clothing such as ties and pants folded in half may be hung.

One or more hanger clip parts 40 coupled to the lower side of the body part 10 are further provided.

The hanger clip part 40, which is configured to be able to be coupled to and separated from the lower side of the body part 10, may be combined and used according to the user's needs, or may be detached and stored separately when unnecessary or cumbersome. In addition, since the hanger clip part 40 is composed of a clip and holds a clothing item by fixing it firmly instead of hanging it, the loss of small items such as socks that are often lost, may be prevented. Moreover, since the upper body clothing may be placed on the hanging parts 15 and the lower body clothing may be hung with the hanger clip parts 40, one hanger may accommodate multiple garments at the same time, making it highly versatile.

A body hook cover 19 wrapping around one side of the hook part 14 in the direction of the body part 10 is further included.

An auxiliary hook cover 29 wrapping around one side of the hook part 14 in the direction of the auxiliary part 10 is further included.

The body hook cover 19, which covers the side facing the body part among the various sides of the hook part 14, may improve the durability of the hook part 14. On the other hand, the auxiliary hook cover 29 covers the side facing the auxiliary part 20 among the sides of the hook part 14. In the body part 10, since the side to which the auxiliary part 20 is coupled is open and the edges thereof is sharp, a user may be injured when pinched or strongly pressed on this part when using the hanger. Nevertheless, the formation of the auxiliary hook cover 29 compensates for the sharpness of the edges.

Figure 6A:
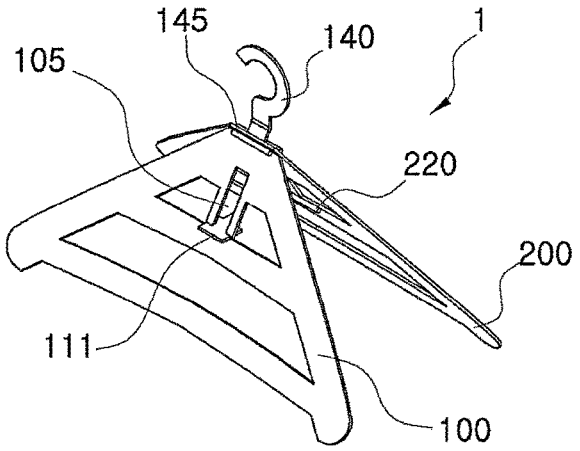
FIG. 6A is a perspective view after expansion of a ventilating hanger and FIG. 6B is a perspective view before expansion of a ventilating hanger, according to another embodiment of the present disclosure.
Figure 6B:
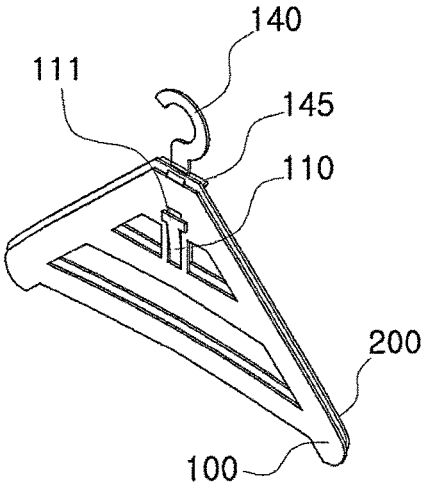

FIG. 6A is a perspective view after expansion of a ventilating hanger and FIG. 6B is a perspective view before expansion of a ventilating hanger, according to another embodiment of the present disclosure.

A ventilating hanger 1 inserted into clothes and forming a predetermined space therein where the clothes are hung, the hanger 1 according to another embodiment of the present disclosure includes:

a body part 100 having a semicircular hook part 140 formed at the top; a body penetration part 105 famed by penetrating one side of the body part 100; an auxiliary part 200 formed corresponding to one side of the body part 100; a hanging rotation shaft 220 formed on one side of the auxiliary part 200 corresponding to the lower part of the body penetration part 105; and an expansion stopper 110 in which one end thereof is rotatably coupled to the hanging rotation shaft 220, and from which an expansion protrusion 111 is formed to protrude at the other end thereof.

The hook part 140 is bent after protruding upward, so that the hanger may be caught on a part of a hanging rod. It is preferable that the hook part 140 is streamlined, but the hook part 140 may be configured in various shapes as long as the hook part 140 can accommodate the rod. The body part 100 has a triangular frame, and the hook part 140 is formed extending from the top.

The body penetration part 105 is a portion formed by penetrating one side of the body part 100, and may be configured to enable interlocking to a fixing member.

The auxiliary part 200 is formed to correspond to the shape of the body part 100 without forming the hook part 140 at the top, and the auxiliary part 200 may be coupled to the body part 100 with a hook shaft 145 formed on the upper side of the body part 100 as a contact point. The auxiliary part 200 has one side attached to the body part 100, and when the expansion stopper 110 rotates to the side around the hanging rotation shaft 220, the auxiliary part 200 may be opened while forming an angle based on the hook shaft 145 fixed to the upper side. The expansion protrusion 111 is slidably fixed to one side of the body part 100 while passing through the body penetration part 105, and is rotatably coupled to the hanging rotation shaft 220 formed in the auxiliary part 200, so that the lower parts of the body part 100 and the auxiliary part 200 may be opened only to a predetermined angle by the expansion protrusion 111 and fixed.

In addition, since the hook part 140 is rotatably coupled to the hook shaft 145 formed on the upper side of the body part 100, the hanger may be easily hung on a part of the rod regardless of the inclination of the body part 100.

Figure 7:
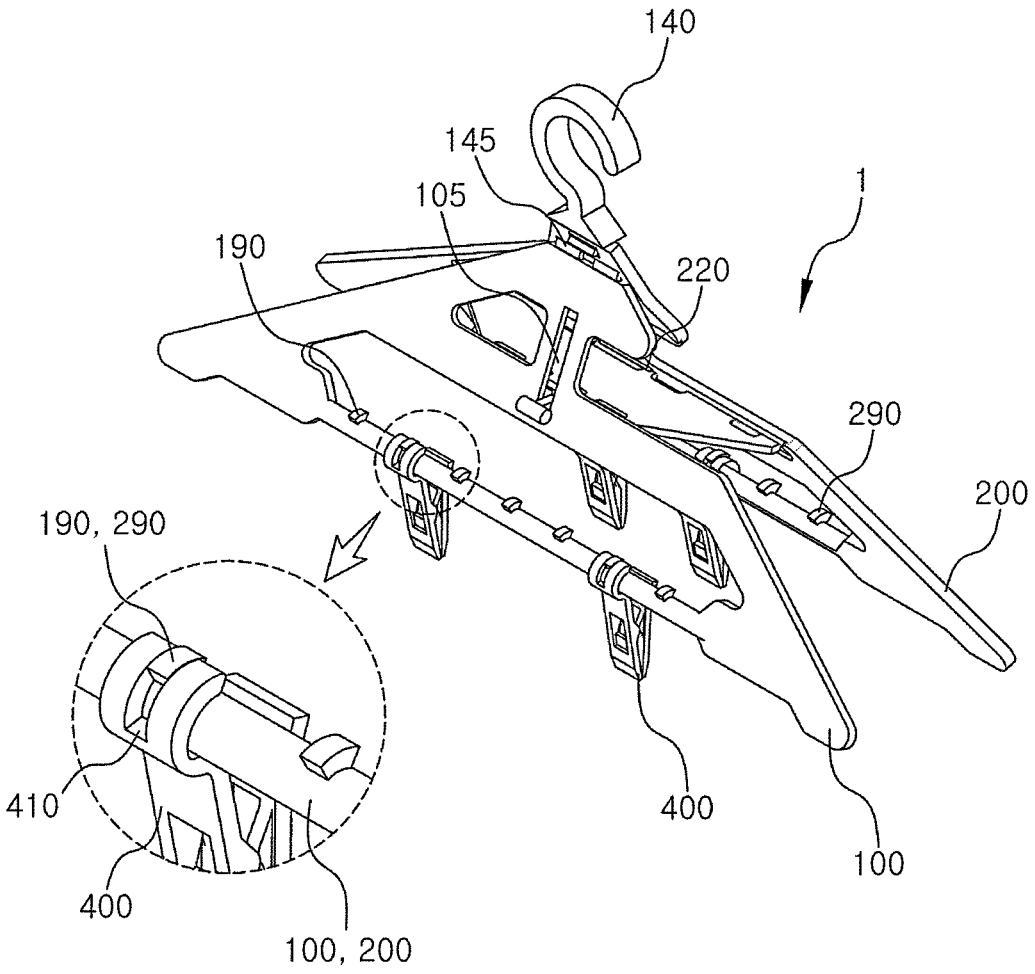
FIG. 7 is a perspective view of a ventilating hanger according to another embodiment of the present disclosure.

Meanwhile, as shown in FIG. 7, one or more hanger clip parts 400 coupled to the lower sides of the body part 100 and the auxiliary part 200 may be further provided.

The hanger clip parts 400, which is configured to be able to be coupled to and separated from the lower sides of the body part 100 and the auxiliary part 200, may be combined and used according to the user's needs, or may be detached and stored separately when unnecessary or cumbersome.

In addition, since the hanger clip part 400 is composed of a clip and holds a clothing item by fixing it firmly instead of hanging it, the loss of small items such as socks that are often lost, may be prevented. Moreover, since the upper body clothing may be placed on the body part 100 or the auxiliary part 200 and the lower body clothing may be hung with the hanger clip parts 400, one hanger may accommodate multiple garments at the same time, making it highly versatile.

When hanging the lower body clothing with the hanger clip parts 400 while the lower part of the body part 100 and the auxiliary part 200 are spread apart, two lower body clothing items, one each, may be hung at a distance from each other on the hanger clip parts 400 installed on the body part and the hanger clip parts 400 installed on the auxiliary part 200. Alternatively, it is also possible to three-dimensionally place one lower body clothing item on the hanger clip parts 400 installed on the body part 100 and the hanger clip parts 400 installed on the auxiliary part 200 with the waist area of the item wide open, so that wrinkles do not occur when a lower body clothing item is placed depending on the type of the item.

A plurality of support protrusions 190 and 290 are formed at regular intervals in the width direction on the lower sides of the body part 100 and the auxiliary part 200, and a support groove 410 in which one of the support protrusions 190 and 290 is inserted and one side thereof is open is formed in each of the hanger clip parts 400, so that the installation position of the hanger clip parts 400 may be designated by the support protrusions 190 and 290.

That is, since the installation position of the hanger clip parts 400 may be adjusted to correspond to any one of the support protrusions 190 and 290, it is possible to install the hanger clip parts 400 at positions capable of accommodating the size of a lower body clothing item to be placed.

Furthermore, as one side of the support groove 410 in the hanger clip part 400 is foamed open, and the hanger clip part 400 is rotatably installed in the body part 100 and the auxiliary part 200, various sizes of lower garments may be held. In addition, since the support groove 410 is restricted from being rotated outward by more than a certain angle by the support protrusions 190 and 290, it is possible to prevent hanging clothes such as a lower garment from being damaged or disengaged due to excessive rotation of the hanger clip parts 400.

Although preferred embodiments of the present disclosure have been described with reference to the accompanying drawings, the embodiments described in this specification and the configurations shown in the drawings are only one of the most preferred embodiments of the present disclosure and do not represent all of the technical spirit of the present disclosure. Thus, it should be understood that there may be various equivalents and modifications that can replace them at the time of this application. Therefore, the embodiments described above should be understood as illustrative in all respects and not limiting. The scope of the present disclosure is indicated by the appended claims rather than the detailed description, and all changes or modifications derived from the meaning and scope of the claims and their equivalent concepts should be construed as being included in the scope of the present disclosure.

INDUSTRIAL APPLICABILITY

The present disclosure relates to a hanger capable of being opened forward/rearward and, more particularly, to a ventilating hanger having a hanging part on which clothes can be hung and which can be opened toward front/back of clothes, so that the hanging part is in a narrow state to allow the clothes to ba easily hung thereon when the clothes are hung, and is opened to be wide forward/rearward in a state in which the clothes are hung thereon, so as to widen the space between the front and back of the clothes, and thus smooth ventilation is facilitated.

The invention claimed is:

1. A ventilating hanger inserted into clothes and forming a predetermined space therein where the clothes are hung, the hanger comprising:

a body part configured to have a semicircular hook part formed at the top;

a body rotation shaft formed by protruding a side of the body part and in which a fitting groove is formed;

an auxiliary part configured to have an auxiliary rotation shaft coupled to a body rotating shaft, and formed corresponding to a side of the body part;

a stopper rotatably coupled to the body part and the auxiliary part and configured to have a fitting protrusion formed thereon, and one or more hanger clip parts coupled to a lower side of the body part.

2. The ventilating hanger of claim 1, further comprising:

hanging parts configured to extend both ends of the body part and the auxiliary part.

3. The ventilating hanger of claim 2, further comprising:

an auxiliary hanging part formed by an upper one side of one of the hanging parts is drawn into a center of the body part.

4. The ventilating hanger of claim 1, further comprising:

a body hook cover configured to wrap around a side of the hook part in a direction of the body part.

5. The ventilating hanger of claim 1, further comprising:

an auxiliary hook cover configured to wrap around a side of the hook part in a direction of the auxiliary part.

6. A ventilating hanger, comprising:

a body part configured to have a semicircular hook part formed at the top;

a body penetration part formed by penetrating a side of the body part;

an auxiliary part formed corresponding to a side of the body part;

a hanging rotation shaft formed on a side of the auxiliary part corresponding to a lower part of the body penetration part; and an expansion stopper in which one end thereof is rotatably coupled to the hanging rotation shaft, and from which an expansion protrusion is formed to protrude at the other end thereof.

7. The ventilating hanger of claim 6, further comprising:

one or more hanger clip parts coupled to lower sides of the body part and the auxiliary part.

8. The ventilating hanger of claim 7, wherein on the lower sides of the body part and the auxiliary part, a plurality of support protrusions are formed at regular intervals in a width direction, and in each of the hanger clip parts, a support groove in which one of the support protrusions is inserted is formed.

* * * * *